US007207345B2

(12) United States Patent
Somerville

(10) Patent No.: US 7,207,345 B2
(45) Date of Patent: Apr. 24, 2007

(54) FLUID ROUTING DEVICE

(75) Inventor: John Matthew Somerville, Hertfordshire (GB)

(73) Assignee: The Technology Partnership PLC, Royston, Hertfordshire (GB)

( * ) Notice: Subject to any disclaimer, the term of this patent is extended or adjusted under 35 U.S.C. 154(b) by 0 days.

(21) Appl. No.: 10/528,576

(22) PCT Filed: Sep. 23, 2003

(86) PCT No.: PCT/GB03/04045

§ 371 (c)(1),
(2), (4) Date: Oct. 6, 2005

(87) PCT Pub. No.: WO2004/028954

PCT Pub. Date: Apr. 8, 2004

(65) Prior Publication Data

US 2006/0157129 A1 Jul. 20, 2006

(30) Foreign Application Priority Data

Sep. 24, 2002 (EP) ..... 02256607

(51) Int. Cl.
*F17D 1/16* (2006.01)
*F15C 1/06* (2006.01)

(52) U.S. Cl. ..... 137/7; 137/3; 137/14; 137/833

(58) Field of Classification Search ..... 137/833, 137/3, 7, 14
See application file for complete search history.

(56) References Cited

U.S. PATENT DOCUMENTS

| | | | | |
|---|---|---|---|---|
| 4,908,112 | A * | 3/1990 | Pace | 210/198.2 |
| 5,842,787 | A * | 12/1998 | Kopf-Sill et al. | 366/340 |
| 5,948,684 | A | 9/1999 | Weigl et al. | |
| 6,136,272 | A | 10/2000 | Weigl et al. | |
| 6,287,520 | B1 * | 9/2001 | Parce et al. | 422/100 |
| 6,676,835 | B2 * | 1/2004 | O'Connor et al. | 210/542 |

FOREIGN PATENT DOCUMENTS

| | | |
|---|---|---|
| EP | 1065378 A2 | 3/2001 |
| WO | 0154784 A2 | 8/2001 |

* cited by examiner

*Primary Examiner*—A. Michael Chambers
(74) *Attorney, Agent, or Firm*—Dykema Gossett PLLC

(57) ABSTRACT

A single layer fluid routing device comprising a first channel having a cross-section of a first aspect ratio and a first depth; a second channel having a second cross-section of a second different aspect ratio and a second different depth; wherein the second channel intersects with the first channel from a first point to a second point, the first and second points having different offsets relative to the cross-section of the first channel.

21 Claims, 4 Drawing Sheets

FLUID ROUTING DEVICE

This invention relates to a single layer fluid routing device and a method of routing fluid within a single layer. The invention relates, in particular, to a fluid routing device and method which can be utilised to mix two or more fluids, preferably in a microfluidic circuit. Although described with reference to microfluidic circuits, the present invention can be equally applied outside of the area, for example in oil pipelines or other fluid networks.

Microfluidic networks, such as those used in so-called "lab on a chip" systems are increasingly common and it is often necessary to mix two or more fluids which are passing within such a microfluidic network, for example, to enable a reaction to take place or to allow one fluid to be diluted by mixing with a different fluid. In such microfluidic networks, the fluid flow is generally laminar and therefore the amount by which the fluids are mixed is limited by the rate of diffusion of the two fluids, which is proportional to the size of the surface area of contact between the fluids.

Mixing two or more fluids with a single interface in a diffusion limited regime is therefore very slow and requires large dead volumes within the network of passages. Consequently, it is necessary to try to maximise the surface area between the fluids to be mixed, and so increase the rate of diffusion.

Typically this is achieved by combining two sets of interlaced channels in each of which a pair of different fluids flows, as shown in FIG. 1, so that a multilayered laminate flow is formed, thereby enabling quicker mixing of the fluids. FIG. 1 shows a simple mixing device 10 having fluid supply channels 11, 12, 13, 14. Channels 11 and 13 supply fluid A and channels 12 and 14 supply fluid B. The four channels are combined to form a four layered laminate flow 15 which has three interfaces between fluid A and fluid B. The increase in the number of interfaces increases the amount of diffusion between the different fluids and therefore reduces the time required for thorough mixing to occur.

Unfortunately, in this form of interdigitated laminar mixing, all the channels 11, 12, 13, 14 have to be connected to individual reservoirs of either fluid A or fluid B to enable this device to be produced within a single microfluidic layer. However, having multiple reservoirs for the same fluid is an inefficient use of space within the device. Therefore, in order to use only a single reservoir for each fluid A and B, a two layered device is desirable.

One example of a simple two layered mixing device 20 is shown in FIG. 2, in which passageways 21 and 22, containing fluid A and B respectively, are brought together in a single passage which is then split into upper 23 and lower 24 pathways, thereby creating the two layers within the device, and which are then brought back together as a four layered laminate flow 25, similar to that produced by the device of FIG. 1.

There are several disadvantages to a two layered construction and these include a greater manufacturing cost due to the need for multiple layers to be shaped and significant manufacturing complexity in aligning the separate layers, typically to micron scale accuracy, which also significantly increases the cost of an individual device. Multilayer systems are also often difficult to prime repeatedly at low pressures and at low flow rates and this leads to incorrect, or at least unreliable, test results.

As cost is a primary parameter in the commercial viability of microchemistry or "lab on a chip" microfluidic circuits, it is an aim of the present invention to provide a fluid routing device using only a single layer, but which does not unduly limit the routing of fluid within the device and hence reduce the function that can be achieved by such a device.

According to the present invention, there is provided a single layer microfluidic fluid routing device comprising:

a first channel having a cross-section of a first aspect ratio and a first depth;

a second channel having a second cross-section of a second different aspect ratio and a second different depth;

wherein the second channel intersects with the first channel from a first point to a second point, the first and second points having different offsets relative to the cross-section of the first channel.

Thus, the present invention provides a device which is capable of moving part of one or more fluids from one position in a flow to a different position in the flow to enhance mixing of the fluids. The device is space efficient as it does not require lengthy passageways in which the diffusion takes place as the flow pathways are relatively short compared to other known devices and therefore means that the mixing is carried out quickly.

When the depths of the channels are equal, the network is pseudo two dimensional and there will generally be little or no crossing of the two flows. However, as the depths of the channel are caused to differ, partial crossing of the flows starts to occur. In many cases, it is desirable to have similar viscous drag on the two fluid flows and so the two channels have opposite aspect ratios; for example 2:1 and 1:2.

As the aspect ratios become more elongated, more complete crossover of the two fluid flows is seen. However the channels become increasingly expensive to fabricate and the viscous drag rapidly increases. Taking these considerations into account, aspect ratios in the range between 1.5:1 and 10:1 are suitable, while aspect ratios in the region of 3:1 to 6:1 are the more preferred.

The present invention also provides a single layer microfluidic fluid routing device comprising:

a first channel having a cross-section of a first aspect ratio and a first depth and having a longitudinal axis; and a second channel having a cross-section of a second different aspect ratio and a second different depth, wherein the second channel passes through at least part of the first channel in a direction transverse to the longitudinal axis.

The cross-section of the intersecting first and second channels may be T-shaped. The first and second channels may be elongate in cross-section typically having an aspect ratio of 5.

The aspect ratio of the first channel may be a 90° rotation of the aspect ratio of the second channel to equalise the flow through each channel and the first and second channels preferably have substantially the same cross-sectional area.

The total cross-sectional area of the first and second channels is preferably also substantially constant.

The second channel may be separate from the first channel until the first point. The second channel may continue beyond the first channel after the second point. Alternatively, the second channel may extend only between the first and the second point.

In an example in which the second channel continues beyond the first channel after the second point, the first and second channels may be recombined to create a multilaminar flow. In this example, the first and second channels may pass through a respective intermediary channel prior to recombination, each intermediary combination having substantially the same aspect ratio cross-section.

The second channel may be formed by a gradual change in aspect ratio from the first point. Alternatively, at the first point, there may be a step which signifies the start of the second channel.

At the second point, there may be a step which indicates the end of the second channel.

The first and second channels may have flow directions which are at 90° to each other.

The first and second points may be at different longitudinal positions in the first channel, each intermediary channel having the same aspect ratio cross-section.

The invention also provides a fluid mixer comprising a fluid routing device as described above and fluid supply means for supplying the fluids supply to be mixed and which is connected to the fluid routing device.

The mixer preferably comprises additional fluid routing devices as described above connected in series, such that an outlet from one device passes into the inlet of a subsequent device.

The fluid mixer may comprise a pair of inlet passages for supplying, in use, different fluids to the first channel. Alternatively, there may be three inlet passages, the outer two supplying a different fluid to the central passage. This is particularly advantageous if the volume of the fluid supplied by the central passage is small compared to the volume of the other fluid, as it increases the number of interfaces even before the fluids enter the routing device itself.

The mixer may additionally comprise a geometric pin between each of the fluid supply passages and the first channel.

According to a second aspect of the present invention, there is also provided a method of routing fluid in a single layer, the method comprising the steps of;

providing a fluid in a first channel having a cross-section of a first aspect ratio;

passing a portion of the fluid from the first channel into a second channel which has a cross-section of a second different aspect ratio and which intersects with the first channel from a first point to a second point, each point having a different offset relative to the cross-section of the first channel; and moving the fluid through the second channel from the first point to the second point.

The method preferably comprises the further step of recombining the fluid from the second channel into a different portion of the fluid in the first channel.

The method may also comprise the step of passing the fluids from the first and the second channels into respective intermediary channels, each of which may have the same aspect ratio cross-section, prior to recombining the fluids from the first and the second channels.

There is also provided a method of routing fluid in a single layer, the method comprising the steps of:

providing a first fluid in a first channel having a cross-section of a first aspect ratio; and flowing a second fluid, within a second channel having a cross-section of a second aspect ratio and intersecting the first channel, across the first channel.

There is also provided a method of diverting fluid from a first channel to a second channel, the method comprising the step of flowing a fluid through a fluid routing device as described above.

Examples of the present invention will now be described with reference to the accompanying drawings, in which.

Figure 3:
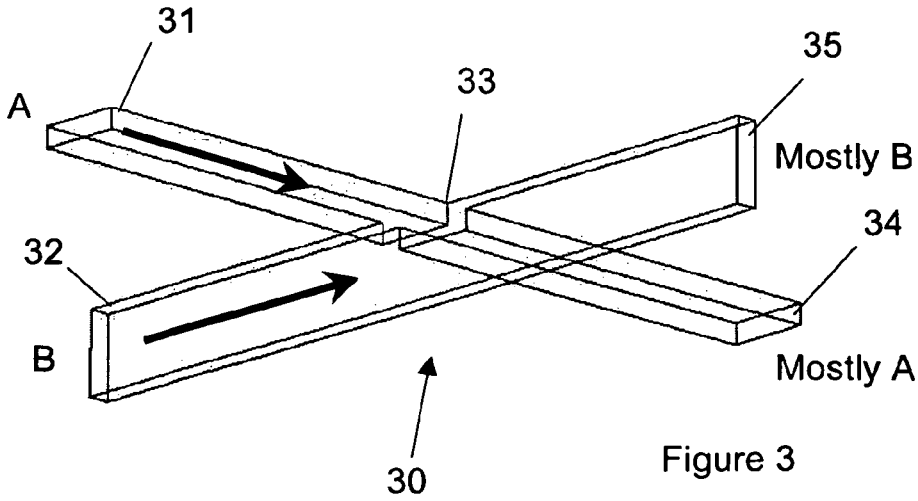
FIG. 3 is a schematic perspective view of one example of a fluid routing device according to the present invention.

FIG. 3 shows a fluid routing device 30 having a first channel 31 and a second channel 32 which are arranged at substantially 90° to one another. Channel 31 carries fluid A and channel 32 carries fluid B. Channel 31 has a relatively wide shallow cross-section, whereas channel 32 has a narrow deep cross-section. Channel 32 passes through channel 31 such that, at the intersection 33, some but not significant, mixing occurs between fluid A and fluid B. Thus, outlet end 34 of channel 31 and outlet end 35 of the channel 32 contain mostly fluid A and fluid B respectively. This is a simple method of crossing two fluids over in a single layer, i.e. within the maximum depth of the deeper channel, and, as some cross contamination occurs at the intersection 33, it is most suited to use in a fluid mixer, an example of which is shown in FIG. 4, where this will be beneficial.

Figure 1:
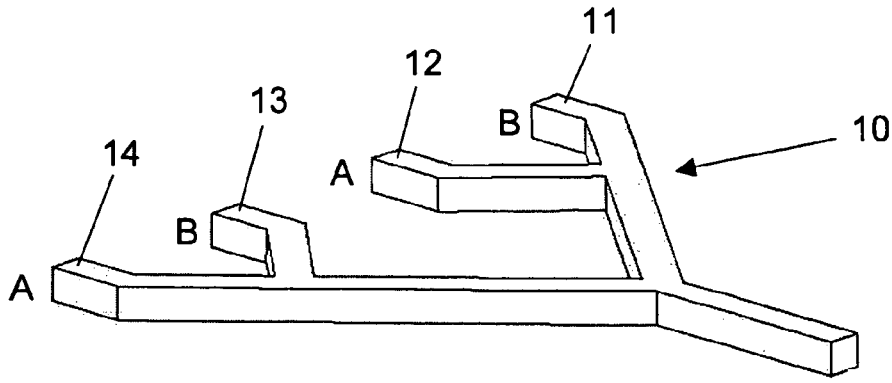
FIG. 1 is a schematic perspective view of an example of a prior art mixer.
Figure 2:
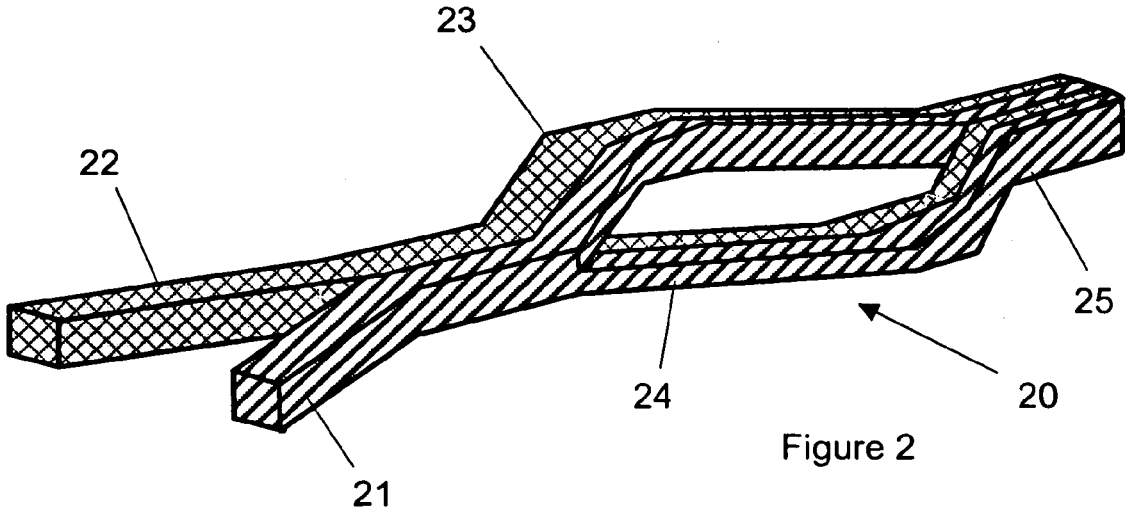
FIG. 2 is a schematic perspective view of another example of a prior art mixer.
Figure 4:
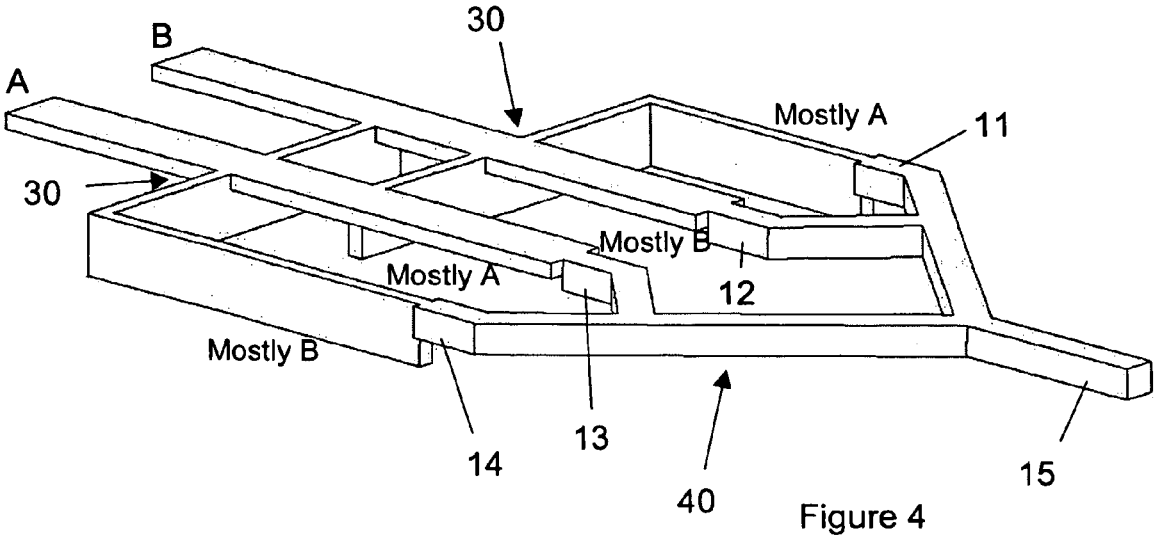
FIG. 4 is a schematic perspective view of a fluid mixer using the fluid routing device of FIG. 3.

As can be seen in FIG. 4, a fluid mixer 40 is provided using two of the fluid routers 30 shown in FIG. 3 and which have been applied to the network of passages 11, 12, 13, 14 from FIG. 1, via a 90° change in aspect ratio, to enable this construction to be formed from a single layer, thereby reducing the manufacturing costs, and the complexity of the design as only a single reservoir is required for each fluid A and B. In this way, a four layered laminate flow 15 is produced at the outlet of mixer 40.

Figure 7:
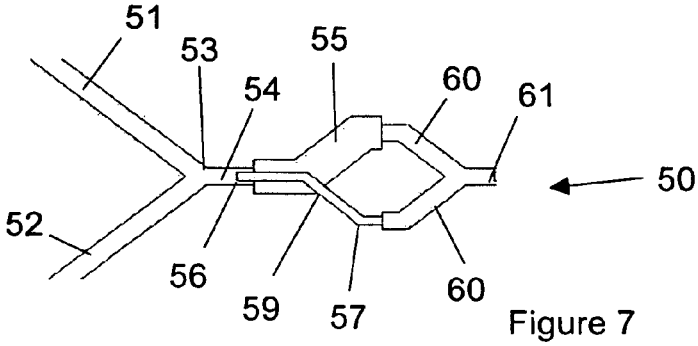
FIG. 7 is a schematic plan view of the mixer of FIG. 5.
Figure 5:
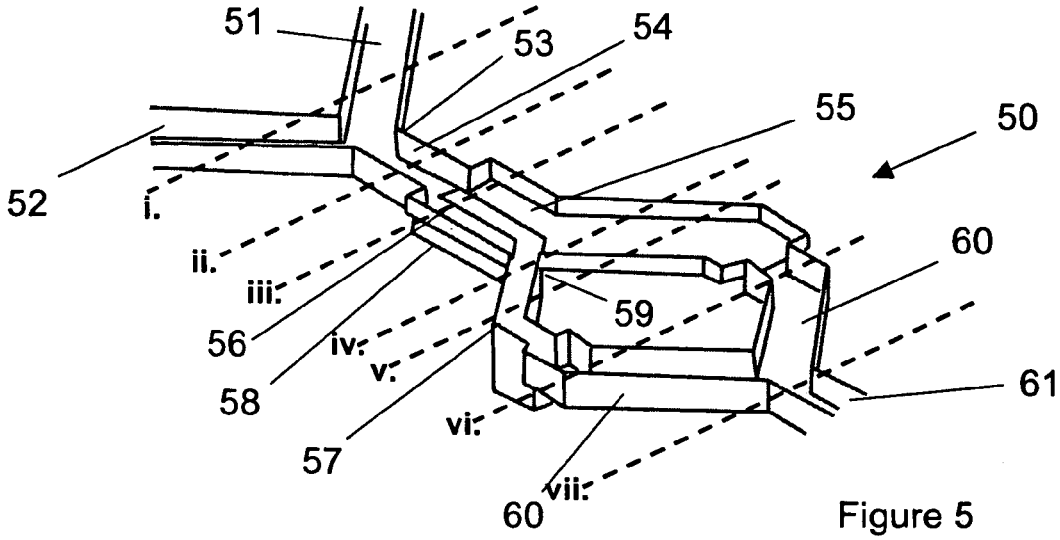
FIG. 5 is a schematic perspective view of another example of a fluid routing device according to the present invention.
Figure 6:
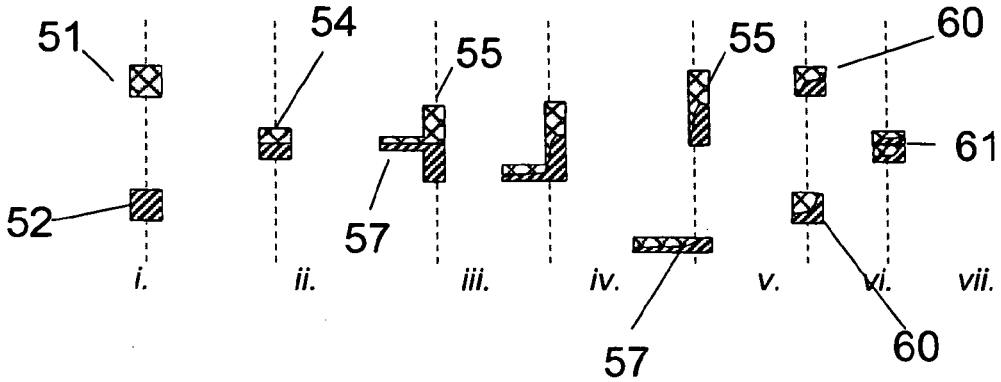
FIG. 6 is a series of cross-sections through the fluid routing device of FIG. 5.

A further example of a device according to the invention is shown in FIGS. 5, 6 and 7 in which a fluid mixing unit 50 includes supply passages 51, 52 which are combined at an intersection 53 to form an inlet passage 54. A wide, shallow first channel 55 extends from the inlet passage 54 and, at a first point 56, a narrow, deep second channel 57 is formed, in this example by a step change 58. The second channel 57 moves across the first channel 55 until, at a second point 59, it separates from the first channel 55.

The first and second channels are then fed into intermediary channels 60 which recombine to form a passageway 61, which contains a four way laminar flow as shown in FIG. 6.

The length of passageway 61 will be dependent upon the fluids used and their flow rate. For example, passageway 61 may be shaped so that it becomes narrower and deeper than at the point at which the channels 60 merge.

FIG. 6 shows the location of the different fluids supplied by passageways 51 and 52 at different cross-sections through the mixer 50 of FIG. 5, and it will be appreciated that between first point 56 and second point 59, the first channel 55 and second channels 57 intersect with each other.

The square cross-section inlet passage 54 transforms, at first point 56, via a step change 58, although this may be a gradual change, into a T-shaped cross-section. The vertical (second channel 57) and horizontal (first channel 55) components of the "T" bifurcate, with both the first channel and the second channel containing a portion of both fluid A and fluid B. The two separate channels can then be recombined, via intermediary channels 60, in channel 61 to give a laminate flow with three interfaces which would be expected to increase the rate of diffusion by the square number of the number of interfaces ($n^2$); in this case n=3.

Figure 8:
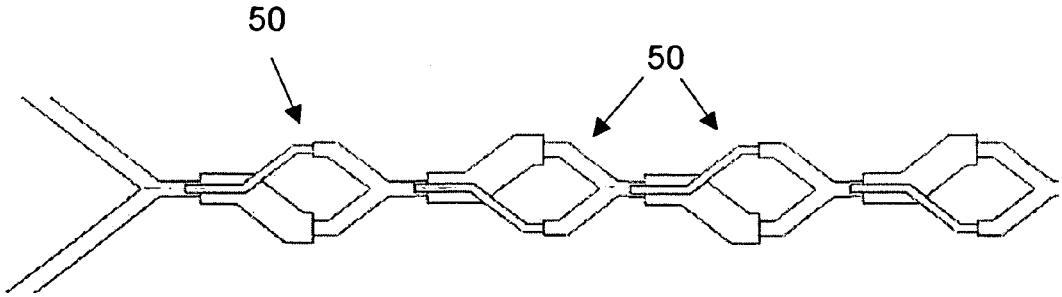
FIG. 8 is a plan view of a fluid mixer using a plurality of units shown in FIGS. 5 and 7.

Importantly, and as shown in FIG. 8, plural mixing units 50 shown in FIG. 5 can be provided in series, each approximately doubling the number of interfaces, thereby introducing an exponential relationship between the number of mixer units and the number of interfaces.

This creates a single-layer mixer which uses chip area efficiently, due to its exponential mixing nature and which, providing the flow regime is laminar, will operate at a wide range of flow rates and channel sizes.

As referred to earlier, priming parallel structures at very low flow rates can be problematic. The present invention is resistant to these problems due to its modular construction, but it is still desirable to improve the priming to make use of every unit in the chain, thereby minimising dead volume and chip area. Techniques such as $CO_2$ priming and the use of a surfactant to solve these problems are well known, but the introduction of extra chemical species to a fluid can be undesirable in sensitive chemical systems.

The use of a hydrophobic dot at the fluid recombination mode, i.e. the junction between passages 60 and 61, can be used to pin the fluids and ensure complete priming, but this can add considerably to the cost of the chip and is therefore also undesirable, given the considerable implications of increase cost described earlier.

Figure 9:
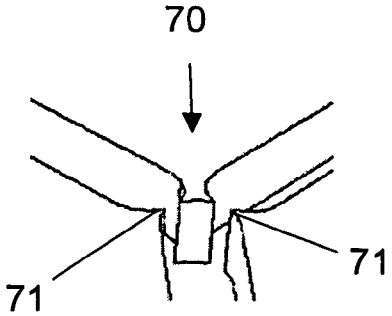
FIG. 9 is one example of a meniscus pinning device for use in the present invention.
Figure 10:
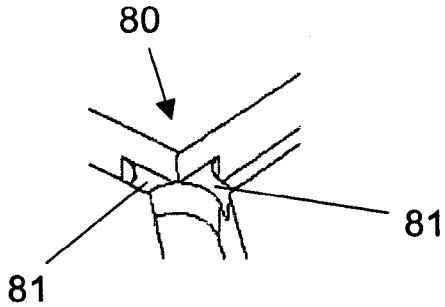
FIG. 10 is another example of a meniscus pinning device for use in the present invention.

Accordingly, simple geometric pins in the recombination mode are the simplest method of ensuring priming, and these can be easily manufactured as part of the fluidic layer at negligible extra costs. Two possible geometries are shown in FIGS. 9 and 10 as examples. Both pins 70, 80 incorporate flow restrictions 71, 81 which pin the first fluid to reach the node until the second fluid arrives at the node. This occurs because, once fluid has reached the flow restriction in one passage, the fluid meniscus forms across the restriction, thereby increasing the resistance to flow. Thus, fluid will flow through the other of the passages, as it has no impediment to the flow, until its meniscus also reaches the flow restriction. At this time, one fluid breaks through one of the restrictions 71, 81 and begins flowing, and this will destroy the remaining pin, thereby ensuring both parallel arms of the structure are fully primed.

While geometric pins may be used to enhance the priming of parallel structures, there is still a problem regarding bubbles from elsewhere in the circuit becoming trapped within the mixer.

For example, when multiple fluids are brought together before mixing, they will be inevitably a timing difference between these fluids. This will often manifest itself in a bubble of trapped air which then be pushed into the fluidic circuit. Another source of bubbles may be the fluid reservoir if this is imperfectly degassed/primed.

Figure 11:
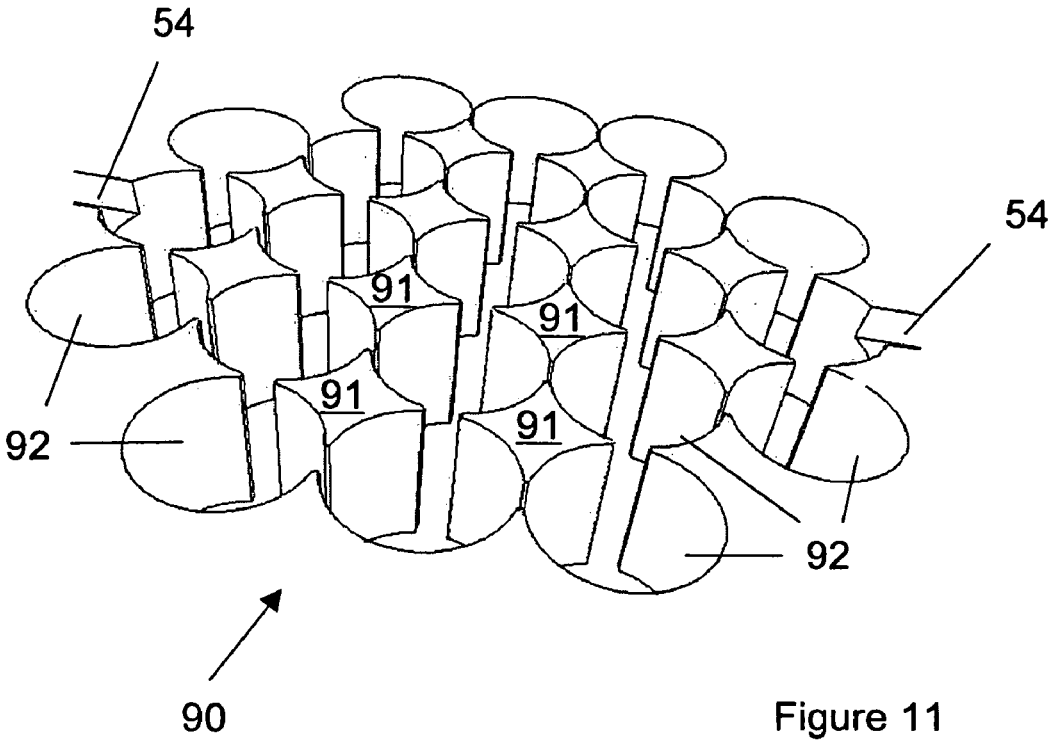
FIG. 11 is a perspective view of a bubble trap according to the invention.
Figure 12:
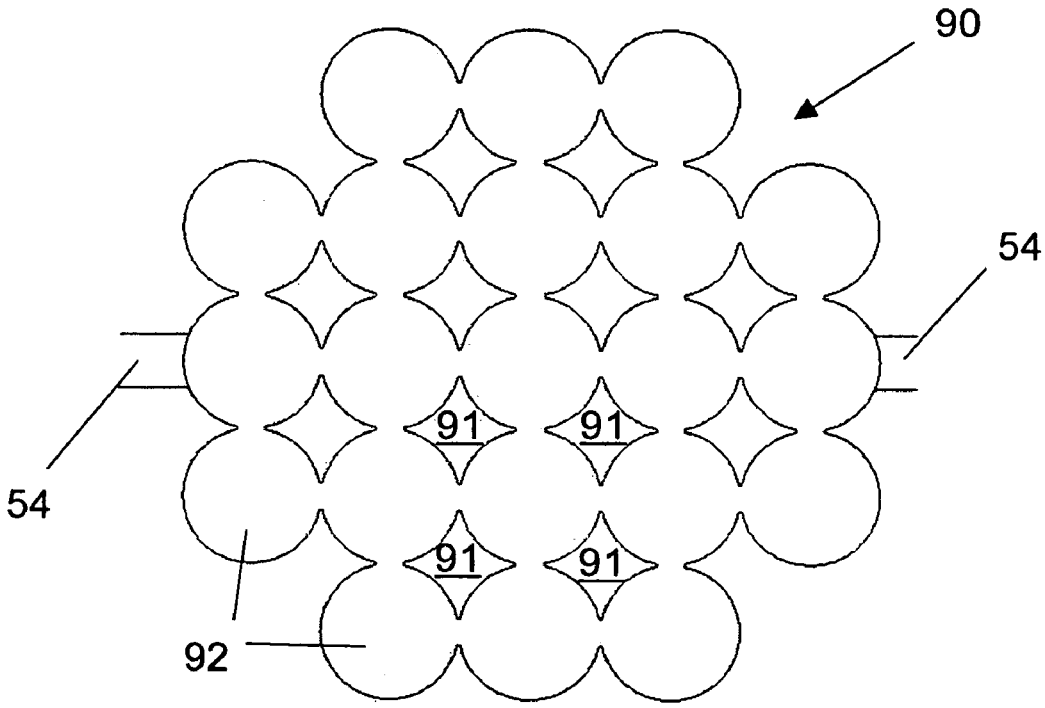
FIG. 12 is a plan view of the bubble trap shown in FIG. 11.

A simple geometric bubble trap 90, as shown in FIGS. 11 and 12, placed after the combination of fluids can be used to capture these bubbles and to prevent them from entering the fluidic circuit where they may cause blockages. A simple design compatible with a single fluidic layer is shown in FIGS. 11 and 12 and comprises an array of pillars 91 which offer many parallel paths from the entrance to the exit. In such a structure bubbles will become trapped in the voids 92, before entering the mixer via channel 54.

The invention claimed is:

1. A method of mixing fluid in a single layer, the method comprising the steps of:

supplying a fluid to a first channel having a cross-section of a first aspect ratio;

supplying a fluid to a second channel which has a cross-section of a second different aspect ratio and which intersects with the first channel from a first location to a second location, each location having a different transverse position and a different longitudinal positions within the first channel and wherein the cross-section of the intersecting first and second channels is T-shaped for at least a portion of the intersection;

passing a portion of the fluid from the first channel into the second channel;

moving the fluid through the second channel from the first location to the second location; and recombining the fluid from the second channel into a different portion of the fluid in the first channel.

2. A method according to claim 1, further comprising the step of passing the fluid from the first and the second channel into respective intermediary channels, each of which has the same aspect ratio cross-section, prior to recombining the fluids from the first and the second channels.

3. A single layer microfluidic fluid mixer comprising:

a fluid routing device having:

a first channel having a cross-section of a first aspect ratio and a first depth; and a second channel having a second cross-section of a second different aspect ratio and a second different depth, wherein the second channel intersects with the first channel from a first location to a second location, the first and second locations having different transverse positions and different longitudinal positions within the first channel and wherein the cross-section of the intersecting first and second channels is T-shaped for at least a portion of the intersection; and fluid supply means for supplying to each channel fluid to be mixed.

4. A mixer according to claim 3, wherein the first and second channels are elongate in cross-section.

5. A mixer according to claim 3, wherein the aspect ratio of the first channel is a 90° rotation of the aspect ratio of the second channel.

6. A mixer according to claim 3, wherein the first and second channels have substantially the same cross-sectional area.

7. A mixer according to claim 3, wherein the total cross-sectional area of the first and second channels is substantially constant.

8. A mixer according to claim 3, wherein the aspect ratios of the two channels are in the range between 1.5:1 and 10:1.

9. A mixer according to claim 8, wherein aspect ratios of the two channels are in the range between 3:1 and 6:1.

10. A mixer according to claim 3, wherein the second channel is separate from the first channel until the first location.

11. A mixer according to claim 3, wherein the second channel continues beyond the first channel after the second location.

12. A mixer according to claim 11, wherein the first and second channels are recombined.

13. A mixer according to claim 12, wherein the first and second channels pass through a respective intermediary channel prior to recombination.

14. A mixer according to claim 13, wherein the intermediary channels have the same aspect ratio cross-section.

15. A mixer according to claim 3, wherein the second channel extends only between the first and the second location.

16. A mixer according to claim 3, wherein the second channel is formed by a gradual change in aspect ratio from the first location.

17. A mixer according to claim 3, further comprising, at the first location, a step which signifies the start of the second channel.

18. A mixer according to claim 3, further comprising, at the second location, a step which indicates the end of the second channel.

19. A mixer according to claim 3, further comprising additional fluid routing devices connected in series.

20. A mixer according to claim 3, further comprising a pair of inlet passages for supplying, in use, different fluids to the first channel.

21. A mixer according to claim 20, further comprising a geometric pin between each of the fluid supply passages and the first channel.

* * * * *